United States Patent [19]

Back

[11] 4,148,474

[45] Apr. 10, 1979

[54] APPARATUS FOR SEPARATING SINGLE SHEETS FROM A STACK THEREOF

[75] Inventor: Günter Back, Hofheim-Diedenbergen, Fed. Rep. of Germany

[73] Assignee: Hoechst Aktiengesellschaft, Frankfurt am Main, Fed. Rep. of Germany

[21] Appl. No.: 835,882

[22] Filed: Sep. 23, 1977

[30] Foreign Application Priority Data

Sep. 27, 1976 [DE] Fed. Rep. of Germany ..... 2643388

[51] Int. Cl.[2] ..... B65H 3/54

[52] U.S. Cl. ..... 271/170; 271/19

[58] Field of Search ..... 271/170, 19, 20, 21, 271/16, 17, 169

[56] References Cited

U.S. PATENT DOCUMENTS 3,592,462 7/1971 Fackler ..... 271/170 X 3,713,645 1/1973 Ferrari ..... 271/170

3,727,910 4/1973 Vora ..... 271/170 X

*Primary Examiner*—Richard A. Schacher

*Attorney, Agent, or Firm*—Schwartz, Jeffery, Schwaab, Mack, Blumenthal & Koch

[57] ABSTRACT

An apparatus for the selective removal of an ultimate sheet of a flexible material from a stack thereof is comprised of a support member for the stack of sheets; a restraining member for applying a restraining force on the stack at one transverse edge thereof; and a pair of pivotal levers disposed adjacent opposing longitudinal edges of the stack, each lever being operatively connected to the restraining member and pivotally connected at first and second movable swivel points on a support member therefor, one swivel point allowing for longitudinal displacement of the lever and the other swivel point allowing for vertical displacement of the lever, in order that the restraining member is capable of being displaced in substantially constant vertical contact with the ultimate sheet in the stack during any subsequent dispensing operations.

9 Claims, 2 Drawing Figures

APPARATUS FOR SEPARATING SINGLE SHEETS FROM A STACK THEREOF

BACKGROUND OF THE INVENTION

1. Field of the Invention

The present invention relates, generally, to a device for separating the utlimate sheet from a stack thereof. More particularly, the device of the present invention relates to one designed to remove the ultimate sheet from a stack of flexible sheets by use of a vertically displaceable separating element located along one transverse edge of the stack, and connected with pivotal levers disposed along opposing longitudinal edges of the stack.

2. Description of the Prior Art

Various devices of the type characterized herein are known in the art for separating the ultimate sheet from the sheets lying therebeneath in the form of a stack. One such apparatus is disclosed in German Offenlegungsschrift No. 2,007,594, which is comprised of separating elements arranged opposite each other to contact the front corners of the stack. Drive rollers are caused to contact the ultimate sheet and advance the same against the restraining force of these separating elements, thus causing the ultimate sheet to arch and bend at the corners until the inherent elasticity of the sheet results in the leading edge thereof resiliently snapping over the lips of the corner separating elements, whereby that sheet is separated from the stack.

The corner separating elements of this disclosed apparatus are mounted on swivel arms which extend along the outer surface of guide bars and execute a generally vertical movement along an arched path. In order to align the front end of the stack to correspond with the arched path along which the separating elements move downwardly, a front stop is provided which is capable of being moved into a vertical position, or from the vertical position into contact with the stack. This stop is employed with a stop unit which is arranged between the separating elements and which is firmly connected, at the lower end, to a shaft mounted for rotation in jaws below the surface of the stacking tray. In a vertical position, the stop unit is disposed behind, and at a slight distance from, the forward section of the separating element to compensate for the arched path thereof. When a stack of sheets is placed in the tray so that the stack contacts the front end of the stop unit, the lower sheets in the stack are arranged behind the downwardly directed sections of the separating element, thus enabling the same to move downwardly along the arched path without interference by these lower sheets in the stack.

The device of this disclosed invention is quite expensive because, in addition to the arms employed to swivel the separating elements, a separate stopping device is provided which must be rotatable about a shaft in order to appropriately account for the arched, downwardly extending path of the separating element. This complex configuration is necessary to render possible the separation of the lowermost sheets of the stack without difficulty.

Another device, similar to the one described above and useful for separating sheets from a stack thereof, is disclosed in German Offenlegungsschrift No. 2,265,108, and comprises control means which cause the corner separating elements to be in substantially constant contact with the corner of the stack during the separating or dispensing process, and to move along a vertically downward path during that operation. To effectuate this operation, a lever is attached to a side plate provided with curved slots or channels which receive pegs protruding from the lever. These elongated curved slots are specifically shaped such that the pegs will follow the contour thereof as the lever is moved, whereby the sheet separating element moves vertically downward. A cam system is provided for lifting the lever along the path, the same being predetermined by the movement of the pegs in the slots or channels. This device also is characterized as comprised of relatively expensive elements, necessary in order to move the corner separating elements along an approximately vertical path.

Accordingly, the need exists to provide a sheet dispensing device which is capable of simple and efficient separation of the ultimate sheet from a stack thereof, and one which, most especially, is of simple design and economical construction.

SUMMARY OF THE INVENTION

In accordance with the noted deficiencies of prior art devices of the variety characterized herein, it is the primary object of the present invention to provide a sheet separating device comprising separating elements which may be easily, and accordingly inexpensively, manufactured, and which may be accurately controlled during movement along a vertical path accompanying dispensing of sheets from the stack.

It is also an object of the present invention to provide such a sheet separating device for the dispensing of individual sheets from a stack thereof, wherein the device is widely adaptable, from a design point of view, for sheets of varying documents, by mathematically defining the structural relationship of elements.

In accomplishing the foregoing objects, it has now been determined in accordance with the present invention that an improved apparatus for the selective removal of an ultimate sheet of a flexible material from a stack thereof is comprised of a support member, including a side wall, for supporting the stack of sheets; a restraining member for applying a longitudinal restraining force on the stack at one transverse edge thereof; a pivotal lever disposed adjacent the longitudinal periphery of the stack for displacing the restraining member along a line normal to the upper surface of the stack, which lever includes a first movable swivel point; and a member comprised of a radial arm pivotally mounted at one end to the upstanding side wall and pivotally attached at its other end to a lever arm intermediate the length thereof for swivelling the lever about the first swivel point. Preferably, there is provided a second movable swivel point on the lever at its terminal end which operates in conjunction with the former swivel point; the former designed to permit displacement of the lever normal to the stack and the latter, or second, swivel point to permit longitudinal displacement of the lever.

The apparatus of the present invention enjoys an advantage in that it provides a sheet separating device of a simple design, and one which is mathematically predictable in terms of the dimensions of its various components. Because the device is substantially composed of but two hinged levers, it is thus possible to reliably separate single sheets from the stack without encountering jamming of the sheet separating elements.

Yet further objects and advantages of the present invention will become apparent upon examination of the follow-ng detailed description, taken in conjunction with the figures of drawing, wherein:

DETAILED DESCRIPTION OF PREFERRED EMBODIMENTS

In order to more fully elucidate upon the various objects and advantages of the present invention, the following detailed description will be given in terms of certain preferred embodiments thereof. However, the same are intended as illustrative only, and in no wise limitative.

Figure 1:
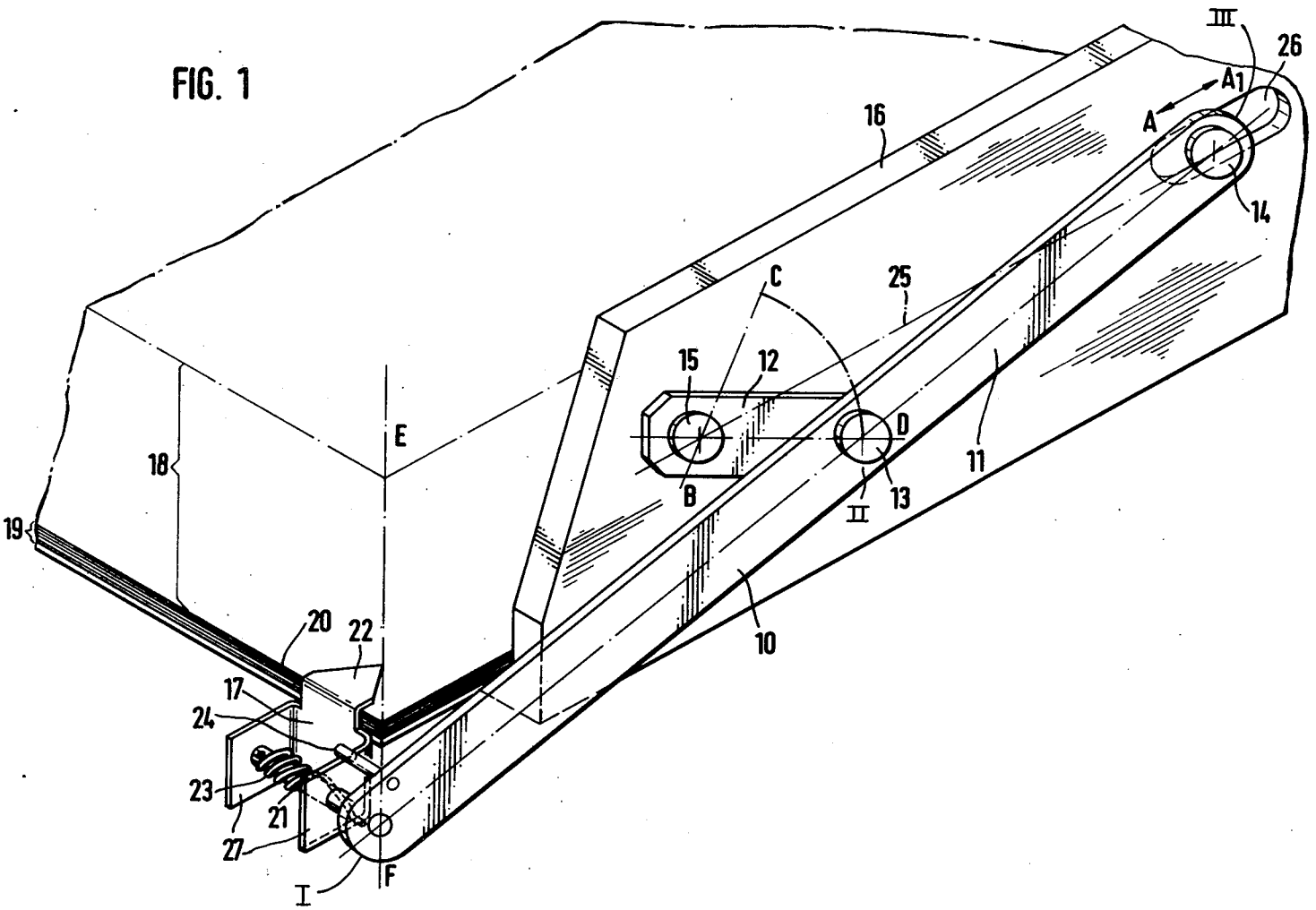
FIG. 1 is a perspective view of a portion of the sheet separating device of the present invention, showing one of the two separating elements and associated hinged levers.

FIG. 1 shows, in partial perspective, a sheet separating or dispensing device 10 of the present invention. For simplicity's sake, as the device is comprised of two identical separating elements and associated hinged levers, only the one is shown in FIG. 1.

In its most essential aspects, the device of the present invention is comprised of a support member for a stack of flexible sheets 19; a pair of separating elements 17 disposed at one transverse end of the stack 19 for applying a restraining compressive force on that stack, and also for precluding longitudinal motion of at least the top of the stack of sheets in a direction toward them; and a pair of hinged lever arms 11 on opposing longitudinal sides of the stack 19, the levers being pivotally dependent from upstanding side walls 16.

Each separating element 17 is comprised of a separating lip 22 which rests upon the surface of the ultimate sheet 20 of the stack 19. The vertical extension of the lip 22 is bent outwardly to yield a pair of laterally extending arms 27, each of which is provided with an aperture through which axle 21 is inserted. The axle 21 is surrounded, in a conventional manner, with a tension spring 23 for biasing the separating element 17 against a stop post 24. The separating element 17 may be revolved or pivoted about axle 21, against the biasing pressure of spring 23, until it rests against the stop 24. The axle 21 is also attached to the lever 11 at one terminal end thereof I in order that the separating element 17 follows vertical displacement upon movement of the lever 11, as described more fully hereinbelow.

The lever 11, having an overall dimensional length L, is attached to upstanding side wall 16 at two movable swivel points, one located as swivel II intermediate the length of the lever 11, and the other at its terminal end III. The intermediate movable swivel II is comprised of a radial arm 12, having a length R, which is attached to side wall 16 at a stationary pivot point 15 by means of a pin or the like. The other end of radial arm 12 is attached to the lever 11 at a similar pivot point 13. The terminal movable pivot III is comprised of a channel 26, most preferably a horizontal channel, formed in the side wall 16. The channel 26 is adapted to receive a swivel pin 14 located at the terminal end of the lever 11. In this fashion, a connecting line 25 drawn between swivel joint 15 and the axis of channel 26 will be a horizontal line.

Separation of the ultimate sheet 20 from the stack 19 is achieved in a fairly conventional manner, and needs but brief description herein as that associated structure forms no part of the present invention. Typically, there will be employed sheet-feeding rollers which rest or otherwise contact the ultimate sheet 20 and which, upon actuation, will apply a force urging sheet 20 against the vertical extension of separating element 17. Since the separating elements 17 oppose the advancement of the sheets, only the uppermost sheet 20 of the stack 19 is pushed over the separating lip 22 and bent upwardly. The sheet is pushed over the lip in a manner such that, by the advancing movement of the feed rollers, a bulge will form in the sheet and increase until, due to its elasticity, the leading edge of the uppermost sheet snaps forward over the separating element, whereas the lower sheets in the stack 19 continue to rest against the vertical extension of the separating elements 17.

FIG. 1 shows the original height 18 of the stack in phantom lines, which has now been reduced to the height 19. Because of the structural arrangement of elements, the separating elements 17 move along the normal line EF as the stack of sheets diminishes in height. With a given height of the stack of sheets, the upper position of the intermediate movable swivel joint 13 is at C, and the lower position of the same swivel joint upon reduction of the stack height to 19, is at D. The movement of the height of the stack downwardly also is accompanied by displacement of swivel pin 14 within channel 26, A denoting the front position thereof and $A_1$ denoting the rear position of the same swivel joint.

The dispensing or sheet separating device of the present invention is widely adaptable for various dimensional configurations of the stack 19. That is, the respective dimensions of the various elements may be described mathematically in order to establish the appropriate interrelationships between the elements comprising the hinged levers 11.

Figure 2:
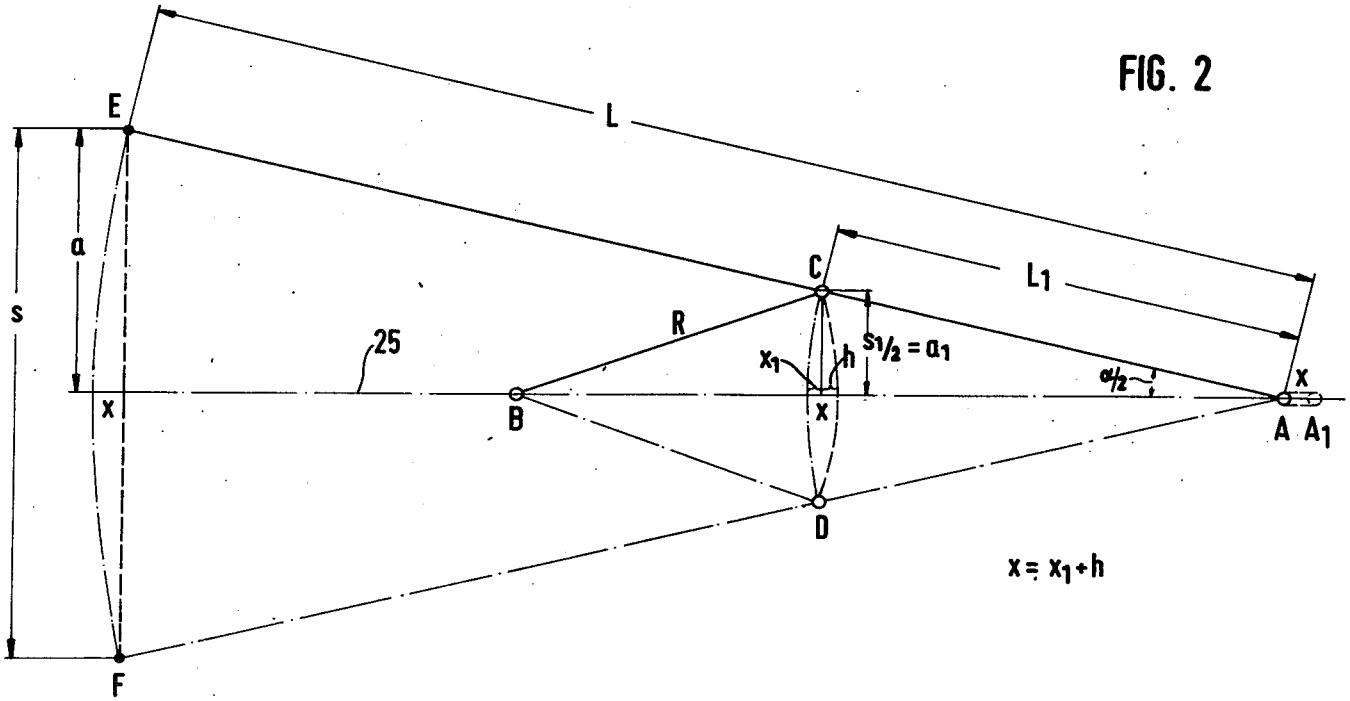
FIG. 2 is a kinematic diagram of the sheet separating device of the present invention, which illustrates the lifting height and the length of the levers of the apparatus from a mathematically descriptive point of view.

FIG. 2 illustrates the relationship between the lever 11 and the radial arm 12. The kinematic diagram of FIG. 2 correlates the lengths of the lever 11 and radial arm 12; and also the interdependence thereof on the lifting heights of the lever 11 and the length $L_1$ from the intermediate movable swivel joint 13 to the terminal movable swivel joint 14. In FIG. 2, the lever 11 and the radial arm 12 are represented by their centerlines only, while the swivel joints 13, 14, and 15 are indicated by their pivot points A, B, C, and D.

Were the lever 11 to be fixedly hinged on pivot A, the lever with length L would describe a circular arc extending from point E to point F. At the bisecting line of the arc EF, a difference in length x exists between the arc and its chordal segment, the dimension of x corresponding to the difference by which the lever 11 must be capable of reciprocating from its front position A to its rear position $A_1$ in the channel 26 of upstanding side wall 16. This compensating dimension x is necessary to permit the separating elements 17 to move vertically downward along the line EF as the sheets are removed from the stack 19, rather than have that element follow an arcuate path EF.

To achieve the vertical movement of the separating element 17 along the chordal line EF, the lever 11 is guided at point C from the point B. This guiding is effectuated by the radial arm 12, having a length R, which is fixedly hinged on the pivot point B and causes arcuate displacement along the path CD. Simultaneously, the lever 11 with length L is displaced from point A to point $A_1$ and thence back to A while the separating element 17 traverses the vertical distance from point E to point F.

As is clear from FIG. 2, if the movable intermediate swivel joint 13 on the lever 11 is displaced in the direction of the second, terminal movable swivel joint 14 by the distance h when the lever 11 is swiveled, and the normal distance between the upper position C of swivel joint 13 and the connecting horizontal line 25 is $a_1$, then the length R of the radial arm 12 is determined by the relationship of the equation $$R = \frac{h}{2} + \frac{a_1^2}{2h} = \frac{h^2 + a_1^2}{2h} \quad (1)$$

If $h = x - x_1$, $a_1 = \frac{s_1}{2} = \frac{L_1}{L} \cdot \frac{s}{2}$, $x_1 = L_1 - \sqrt{L_1^2 - (\frac{s_1}{2})^2}$, and $x = L - \sqrt{L^2 - (\frac{s}{2})^2}$, the following equation (2) follows from equation (1):

$$R = \frac{(L - L_1)^2(1 - \sqrt{1 - (\frac{s}{2L})^2})^2 + (\frac{L_1}{L})^2(\frac{s}{2})^2}{2(L - L_1)(1 - \sqrt{1 - (\frac{s}{2L})^2})} \quad (2)$$

For a lifting height s, of the separating element 17, of 90 mm, a length $L_1$ of 80 mm, and a length L of the lever 11 of 200 mm, the following values result, for example, from equation (2):

$x$=5.13 mm, $x_1$=2.05 mm, $h$=3.08 mm, $s_1/2$=18 mm, and $R$=54.19 mm.

It therefore follows from equation (2) that, for a given lifting height s and a given length L of the lever 11, the length $L_1$ of the lever from the intermediate swivel joint 13 to the terminal swivel 14 may be freely selected, but that the length R of the guide rod 12 is then necessarily restricted by the relationship described above.

Accordingly, the device of the present invention operates at least as efficiently as those conceptually similar devices of the prior art; and indeed more efficiently than most, insofar as jamming of the lever is substantially precluded. The efficiency is achieved with a simplicity of design which further contributes to a reduction in expense over those prior art devices heretofore employed.

While the invention has now been described with reference to certain preferred embodiments, the skilled artisan will readily appreciate that various modifications, changes, substitutions, and omissions, may be made without departing from the spirit thereof. Accordingly, it is intended that the scope of the present invention be limited solely by that of the following claims.

What is claimed is:

1. Apparatus for the selective removal of an ultimate sheet of a flexible material from a stack thereof, comprising:

(a) support means, including a side wall, for supporting a stack of sheets of a flexible material;

(b) restraining means for applying a longitudinal restraining force on said stack at one transverse edge thereof;

(c) a pivotal lever disposed adjacent the longitudinal periphery of said stack for displacing said restraining means along a line normal to the upper surface of said stack, said lever having a first movable swivel point; and, (d) means comprising a radial arm pivotally mounted at its first end on said side wall and pivotally fixed at its second end to said lever intermediate the length thereof, for swivelling said lever about said first swivel point.

2. The apparatus of claim 1, wherein said restraining means are connected to said pivotal lever at its first end, said apparatus further comprising a second movable swivel point pivotally connecting said lever at its second end to said side wall, said first movable swivel point defining means for displacement of said lever arm normal to said stack and said second movable swivel point defining means for longitudinal displacement of said lever arm.

3. The apparatus of claim 2, wherein:

(a) said restraining means comprises a pair of restraining elements spaced along one transverse end of said stack; and, (b) said pivotable lever comprises a pair of pivotable lever arms disposed adjacent opposing longitudinal edges of said stack.

4. The apparatus of claim 2, wherein the pivot point of the first end of said radial arm and said second movable swivel point lie on a common horizontal line.

5. The apparatus of claim 4, wherein said second movable swivel point comprises a horizontal channel in each of said side walls for receiving a swivel pin attached to the second end of said lever arm.

6. The apparatus of claim 3, wherein said restraining means comprises:

(a) a separating lip for contacting the upper surface of said ultimate sheet;

(b) an extension of said lip for contacting the edge of said ultimate sheet; and, (c) biasing means for applying said restraining force.

7. The apparatus of claim 5, wherein the second end of said radial arm describes a circular arc during vertical displacement of said restraining means, the horizontal component of said arc causing horizontal displacement of said first swivel point within said channel.

8. The apparatus of claim 7, wherein the dimension of said horizontal component and the dimension of said horizontal displacement are substantially identical.

9. The apparatus of claim 2, wherein the length R of said radial arm is calculated as:

$$R = \frac{h^2 + (\frac{L_1}{L})^2(\frac{s}{2})^2}{2h} = \frac{(L - L_1)^2(1 - \sqrt{1 - (\frac{s}{2L})^2})^2 + (\frac{L_1}{L})^2(\frac{s}{2})^2}{2(L - L_1)(1 - \sqrt{1 - (\frac{s}{2L})^2})} \quad (2)$$

wherein:

L is the length of said lever;

s is the lifting height of said lever; and, $L_1$ is the distance between the said second swivel point and the pivotal attachment point of said radial arm to said lever.

* * * * *